US006129504A

United States Patent [19]

Gämmerler et al.

[11] Patent Number: 6,129,504

[45] Date of Patent: Oct. 10, 2000

[54] METHOD OF PALLETIZING SHEET-LIKE PRODUCTS USING A STACK GRASPER

[75] Inventors: Peter Gämmerler, Berg; Peter Gauges, Wolfratshausen; Michael Taffertshofer, Weilheim; Helmut Krickl, Geretsried, all of Germany

[73] Assignee: Gammerler AG, Germany

[21] Appl. No.: 08/887,097

[22] Filed: Jul. 2, 1997

[30] Foreign Application Priority Data

Jul. 3, 1996 [DE] Germany ..... 196 26 802

[51] Int. Cl.[7] ..... B65G 57/06

[52] U.S. Cl. ..... 414/802; 414/792.9; 414/793.5

[58] Field of Search ..... 414/792.8, 792.9, 414/793.5, 802

[56] References Cited

U.S. PATENT DOCUMENTS

| | | | |
|---|---|---|---|
| 4,383,788 | 5/1983 | Sylvander | 414/792.9 |
| 4,432,686 | 2/1984 | Feldkämper | 414/793.5 |
| 4,746,255 | 5/1988 | Roccabianca et al. | 414/792.9 X |
| 4,820,104 | 4/1989 | Kwauka | 414/792.8 X |
| 4,927,321 | 5/1990 | Lucas | 414/900 X |
| 5,141,274 | 8/1992 | Hayden et al. | 414/792.9 X |

FOREIGN PATENT DOCUMENTS

| | | |
|---|---|---|
| 0359299 | 3/1990 | European Pat. Off. . |
| 0377399 | 7/1990 | European Pat. Off. . |
| 2126315 | 3/1972 | Germany . |
| 2224280 | 12/1973 | Germany . |
| 3024133 | 1/1982 | Germany . |
| 3024112 | 2/1982 | Germany . |
| 205146 | 12/1983 | Germany . |
| 3527902 | 2/1987 | Germany . |
| 4203118 | 5/1993 | Germany . |
| 9418577 | 2/1995 | Germany . |
| WO 95/29865 | 11/1995 | WIPO . |

*Primary Examiner*—Janice L. Krizek
*Attorney, Agent, or Firm*—Fitch, Even, Tabin & Flannery

[57] ABSTRACT

A stack grasper, in particular for unbound printed products comprises a stack receiving space (22) which is open towards the bottom, a guide (14, 16, 18, 20) at all four sides of the stack receiving space, and a stack support (24, 26) on which the stack lies flat and substantially with its full length and/or width. It has the special feature that the stack support (24, 26) is arranged in the region of the lower end of the guide (14, 16, 18, 20) and is movable into and out of and into the stack receiving space (22) by a horizontal movement. This type of grasper ensures good guidance of the stack and a compact design suitable for a stack grasper attached to the arm of a robot.

4 Claims, 1 Drawing Sheet

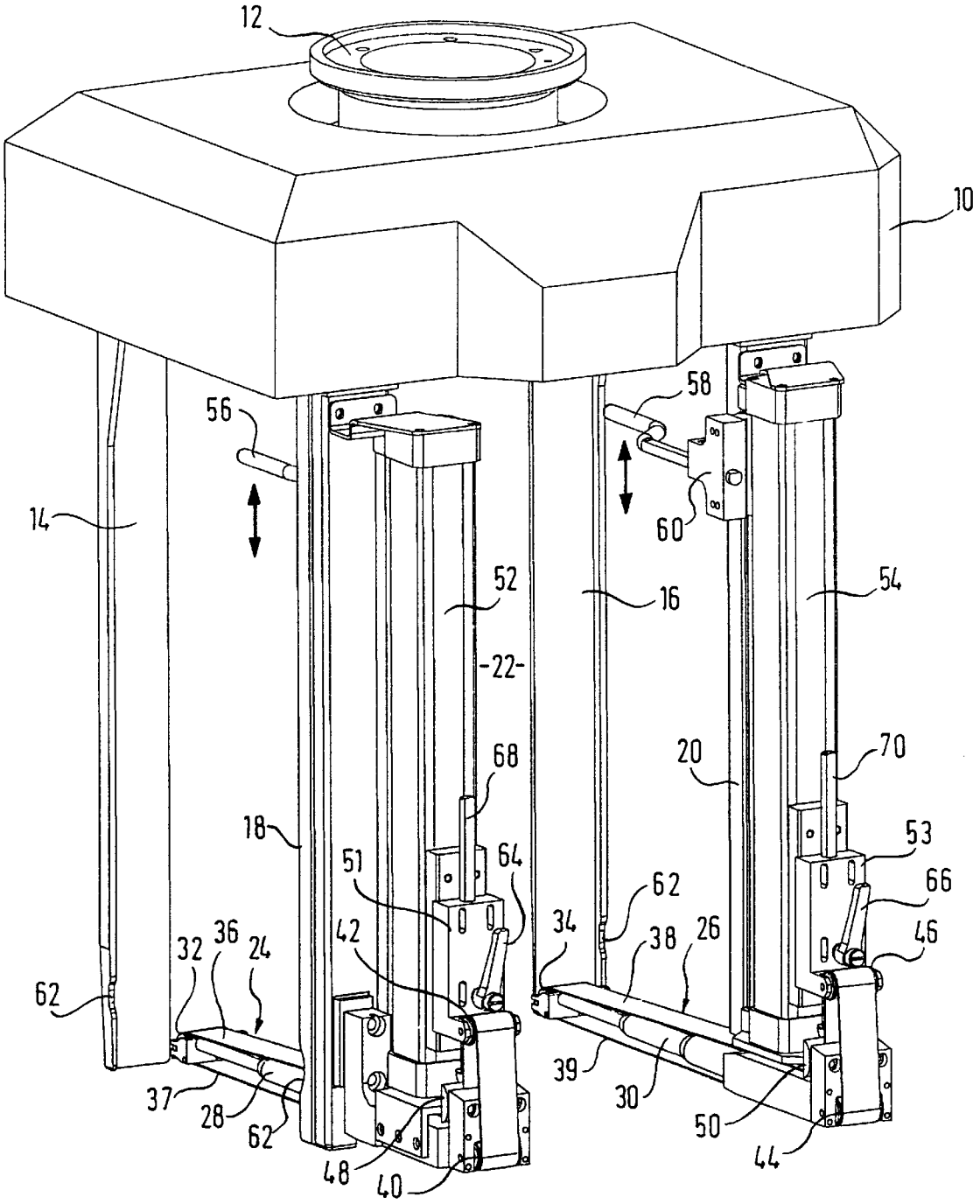
12
10
56
58
14
60
52
16
54
-22-
68
20
70
18
53
51
64
62
66
42
34
38
26
46
32
36
24
62
39
30
37
28
62
50
48
40
44

METHOD OF PALLETIZING SHEET-LIKE PRODUCTS USING A STACK GRASPER

FIELD OF THE INVENTION

The present invention relates to a stack grasper, in particular for unbound printed products comprising a stack receiving space which is open towards the bottom, a guide at all four sides of the stack receiving space, and a stack support on which the stack lies flat and substantially with its full length and/or width.

BACKGROUND OF THE INVENTION

Such stack graspers are known and serve to palletise stacks of printed products with the aid of a robot arm. In this arrangement the stack grasper is mounted at the end of a robot arm and takes over the stack from a supply device in order to subsequently deposit the stack on a pallet.

With stack graspers of the initially named kind, a drop shaft or chute which has approximately the height of a complete stack is arranged beneath the stack support. Individual stacks can admittedly be deposited on the pallet with a very small mutual spacing through this small drop shaft. An orderly placement of the stack is, however, not always possible without disturbing the orderly shape of the stack because the stack support is pivoted about a horizontal axis in order to free the stack and because the stack then falls over a relatively long distance within the drop shaft.

OBJECT OF THE INVENTION

It is accordingly the problem (object) underlying the present invention to so further develop a stack grasper of the initially named kind that the product stacks can be placed on pallets while remaining absolutely stable in shape.

BRIEF DESCRIPTION OF THE INVENTION

The solution of this object takes place in particular by an arrangement in which the stack support is arranged in the region of the lower end of the guide and in which the stack support is movable out of and into the stack receiving space by a horizontal movement.

Through the solution in accordance with the invention the stack no longer falls at all within the stack grasper within a predetermined path, because the stack support is arranged in the region of the lower end of the guide. Because the stack support can be moved out of the stack receiving space through a horizontal movement, it can be "drawn out" from beneath the stack, with the stack still being held on all sides by the guide. Thus, the lower side of the stack simply slides from the guide but does not, however, undergo any falling movement.

The stack grasper of the invention can be made very compact because the height of the stack grasper corresponds approximately to the maximum stack height. Moreover, the operation of the stack grasper of the invention produces very little noise because no flaps or fingers are present which have to be pivoted at high speed against an abutment in order to free a drop path.

Advantageous embodiments of the invention are set forth in the description, the drawing and the subordinate claims.

Thus, the stacking support can have at least one positioning cylinder, preferably a telescopic cylinder, as a support element. By using a cylinder of this kind, the stack support can be fully removed from the stack receiving space, without the stack support then projecting far into the space. This is of particular advantage since the working range of the robot should always be kept as small as possible. By using a telescopic cylinder, a situation can, however, be prevented in which parts project beyond the outer side of the stack grasper when the stack support is opened, so that the working range of the robot can be kept as small as possible.

In accordance with a further embodiment of the invention, the stack support has at least one flexible support belt. Through this embodiment a belt-like support is provided for the first time in a stack grasper, which can be "rolled off" or "peeled off" from the lower side of the stack, without a relative movement taking place between the stack support and the lowermost product of the stack. In this way the stack support can be removed from the stack receiving space without any friction, whereby the shape of the stack remains absolutely stable. This stack support can be moved into the receiving space by a telescopic cylinder or also by a thrust chain. A thrust chain of this kind is put together from individual links and can only be curved in one direction out of the straight shape. If a thrust chain of this kind is used without a belt-like support as a support element, then the stack can be deposited on a thrust chain of this kind or on a plurality of thrust chains. On movement of the thrust chain out of the stack receiving space it is, in each case, deflected about a deflection roller or about a guide for sliding movement with a horizontal axis, and is moved vertically upwardly outside of the stack receiving space. In this way, as with a positioning cylinder, the stack support can be drawn out from beneath the stack so that the latter slides from the support, but does not, however, drop.

It is particularly advantageous when the support belt is guided around a deflection roller or around a guide for sliding movement, with the upper run of the support belt being tensioned between the deflection roller and a holding point outside of the stack receiving space. At the same time, the lower run of the support belt can be withdrawn in order to move the stack support out of the stack receiving space. In this embodiment the support belt is removed from the stack receiving space in that the free end of the lower run is drawn out of the stack receiving space. Through this the displaceable deflection roller is displaced and the upper run of the support belt rolls off from the lower side of the stack, but without any relative movement taking place between the support belt and the lower side of the stack. It is particularly advantageous when the free end of the lower run is secured to a lifting cylinder, preferably a lifting cylinder without a piston rod, which is movable parallel to the guide. This embodiment ensures a compact design because the lifting cylinder without a piston rod can extend parallel to a rail of the guide, and thus likewise does not project very far into the space. At the same time, the guide rail can be used as a mounting for the lifting cylinder.

A particularly advantageous design of the invention is present when the holding point of the upper run of the support belt can be displaced opposite to the direction of movement of the stack support when the lower run is drawn out over a predetermined path. When removing the stack support, i.e. the positioning cylinder surrounded by the support belt, the stack does not execute any dropping movement. However, a certain vertical offset results at the lower side of the stack when the stack support is withdrawn from the stack receiving space. This vertical offset leads to a situation in which a certain offset arises at that side of the stack from which the stack support moves away, i.e. the edges of the products do not lie exactly above one another there. Through the above described embodiment, the upper run of the support belt can, however, be displaced on drawing out of the lower run by a predetermined amount, namely by the offset, opposite to the direction of movement of the stack support, whereby the lower stack region, which is not fully aligned, is displaced together with the upper run against the direction of movement of the stack support. In this way the lower stack region is again aligned in an orderly manner so that the outer edges of the stack form vertical surfaces. The displaceable mounting of the holding point of the upper run can, for example, be achieved by a resilient attachment of the holding point. The holding point can, however, also be displaced in a controlled manner at a certain point in time by a predetermined amount, with the point in time being capable of being selected in such a way that the offset which arises is ideally compensated, for example at the centre of the draw-out movement of the stack support.

It is particularly advantageous when the support belt is guided around a deflection roller which is arranged at the free end of the positioning cylinder or of the thrust chain. In this case the stack admittedly lies on the positioning cylinder, or on the thrust chain, but only contacts the support belt lying therebetween. On retraction of the positioning cylinder or of the thrust chain the support belt then rolls off from the lower side of the stack free of friction. The weight of the stack is, however, always carried by the positioning cylinder or by the thrust chain.

In accordance with a further advantageous embodiment, at least one hold-down device is provided within the stack receiving space and can be set against the upper side of the stack. In this way attention is paid to ensuring that no deformation of the stack occurs with the (very rapid) movement of the robot arm, and that no products, for example individual sheets, separate from the top side of the stack. Particularly when a situation exists in which the guide is not closed at all sides, but is rather, for example, formed by corner rails, then an air space remains between these corner rails, which under some circumstances leads to the topmost products being blown around with a rapid movement. It is particularly advantageous for this arrangement when the hold-down device is vertically adjustable within the full stack receiving space. Since holding down is then possible, even with varying stack height or with stacks which only consist of a few products. It is advantageous when the hold-down device is arranged above the stack support when seen from above. In this case the force which the hold-down device exerts extends precisely perpendicular to the stack support so that the stack does not undergo bending deflection but is rather clamped between the hold-down device and the stack support.

A particularly advantageous manner of operation results through the hold-down device, which is vertically movable within the stack receiving space, since in this case the hold-down device can also press onto the laid down stack when the stack grasper has already been lifted. The hold-down device is thus moved downwardly, opposite to the movement of the stack grasper, and exerts a pressure on the stack until the hold-down device has reached its lower end abutment. In this way the stack is kept together as a compact packet until the stack grasper has completely lifted from the stack. Any friction which arises between the products and the guide does not therefore have a negative effect on the alignment of the stack. An eventual air current which is caused by the upward movement of the stack grasper also has no effect on the alignment of the stack.

In accordance with a particularly advantageous embodiment, a signal generator can be provided which is arranged at the lower end point of the hold-down device. It is possible, through a signal generator of this kind, to generate a signal by the hold-down device which has reached its lower end point through lifting of the stack grasper, with the signal, for example, generating a vertical measurement value with the aid of the robot control. Thus, after each placement of the stack, the precise stack height can be determined in that the corresponding height value is read out from the robot control when the signal generator responds. This represents a substantially more reliable solution when compared to ultrasonic sensors or the like. Moreover, the individually determined measured height values for one layer can be averaged, and this average value can be used for the control for the subsequent stack layer. Two hold-down devices are preferably provided, which in each case cooperate with a signal generator. In this way a good vertical measurement can be achieved by average value formation.

Finally, the guide of the stack receiving space can be provided with aligned cut-outs, which enable the removal of a supply device from the stack receiving space. In this way products with very small format can also be transported by the stack grasper since the all-sided guide can be moved up to the product and a removal of the supply device from the stack receiving space is nevertheless possible.

DESCRIPTION OF THE PREFERRED EMBODIMENT

The invention will be described in the following purely by way of example with reference to an advantageous embodiment and to the accompanying drawing.

The FIGURE shows a perspective view of a stack grasper in accordance with the invention.

The stack grasper of the invention consists of an upper part 10 with a circular flange 12 attached to its upper side in order to secure the stack grasper to an arm of a robot. A total of four guides 14, 16, 18, 20 are mounted on the upper part 10 and guide the stack on all sides. The guides are respectively formed as rails of L-shaped cross-section which extend vertically from the upper part 10 and guide the stack at its four corners. In this way a good guidance is obtained, on the one hand, and the friction between the stack and the guide is reduced, on the other hand. The guide rails 14, 16, 18, 20, which form a stack receiving space 22 which is open towards the bottom, are each secured in the upper part 10 so as to be capable of displacement in parallel whereby, on the one hand, a format adjustment can take place and, on the other hand, the stack receiving space can be widened for the introduction of a stack and can be made smaller after the introduction of a stack. The displacement of the guide rails takes place in this arrangement through parallel guides, which are not shown in more detail.

A stack support 24, 26 on which the (non-illustrated) stack is supported in a flat manner over its full length and/or width is located at the lower end of the guide rails. The flat support of the stack is important, since it would not be possible to unload the stack in a stable shape if, for example, the stack is supported in a curved manner within the stack grasper.

The main elements of the supports 24 and 26 are in each case telescopic cylinders 28, 30. A deflection roller 32, 34, which is rotatable about a horizontal axis extending perpendicular to the telescopic cylinder, is secured to the front end of the respective telescopic cylinder 28, 30 by means of a holder. The telescopic cylinders 28, 30 are arranged in such a way that the deflection rollers 32, 34 attached to their front ends are located outside of the stack receiving space 22 when the cylinders are fully retracted. In the FIGURE only one telescopic cylinder 28, 30 can admittedly be recognised in each case. However, in practice, two telescopic cylinders which lie parallel alongside one another are provided in each case, with a guide roller 32, 34 being secured to the front end of each telescopic cylinder.

The stack supports 24, 26 have a flexible support belt or band 36, 38 alongside the telescopic cylinders 28, 30 as a further support element, and the flexible support belt is in each case guided about a respective deflection roller 32, 34. The free end of the respective upper run is thereby secured to a holding point outside of the stack receiving space 22. The lower run 37, 39 of the support belts is led out of the stack receiving space 22 at the lower side of the telescopic cylinders 28, 30 and is guided around two further deflection rollers 40, 42 and 44, 46 respectively. The free end of the lower run is finally fixed in place, at a fixed location, at a holder 48, 50.

The deflection rollers 40, 44 are respectively journalled at a fixed location on the associated guides 18, 20. The deflection rollers 42, 46 are, however, secured to a cylinder 52, 54 which does not have a piston rod, which extends parallel to the associated guide rails 18, 20 and is secured to the latter. Thus, the lower run 37, 39 of the support belts 36, 38 are removed from the stack receiving space 22 by a vertically upward movement of the carriages 51, 53, provided the telescopic cylinders 28, 30 are simultaneously retracted, for example by venting. At the same time the upper run of the support belts 36, 38 rolls off from the lower side of the stack, i.e. the stack slides from the supports 24 and 26 within the stack receiving space. When the carriages 51, 53 are located at their upper end point, the telescopic cylinders 28, 30 are fully retracted and both the support belts 36, 38 and also the deflection rollers 32, 34 are located outside of the stack receiving space. The stack supports 24 and 26 have then been drawn out from beneath the stack, i.e. the stack lies flat on its support.

A hold-down device 56, 58 is, furthermore, arranged on each of the guide rails 18 and 20. Each hold-down device is of bar-like form and bent towards the outside in such a way that the contact takes place as close as possible to the edges of the stack. In this way a lateral fanning out of the stack is prevented. Each hold-down device is secured to a carriage 60, which can be moved up and down by means of a linear cylinder within the stack receiving space 22 parallel to the respective guide rail 18, 20.

A cut-out 62 is in each case provided at the lower end of each guide rail 14, 16, 18 and 20, with the two respective cut-outs being aligned with one another in each case. These cut-outs make it possible for an apparatus which guides the stack to be withdrawn from a stack grasper, even when a very small format has been selected. For larger formats the cut-outs can also be closed so that they are not a source of disturbance.

The manner of operation of the stack grasper of the invention will be described in the following.

In order to be able to unload a stack on a pallet at the desired position, the stack grasper which is secured to a (non-illustrated) arm of a robot is pivoted into the region of a supply device which "hands over" the stack, for example with grippers at the top and bottom. The stack grasper of the invention is in this arrangement placed in front of the supply device in such a way that the stack handed over can be introduced into the stack receiving space 22 transversely to the stack supports 24, 26. As the guide rails 14, 16 and 18, 20 are spaced apart sufficiently that the stack can be passed through between them, the stack can be introduced into the stack receiving space without contact. Once the supply device has stopped, the guides 14, 16, 18 and 20 are adjusted so that they surround and contact the stack on all sides. Hereupon the supply device can be withdrawn from the stack grasper so that the bottom side of the stack comes to lie on the supports 24 and 26. Depending on the speed of the robot, the stack grasper can, however, also be lowered onto the handed over stack from above.

After pivoting of the robot arm to the desired position on the pallet, the stack grasper is positioned at a small distance from the support surface so that no contact takes place between the moving lower run of the support bands 36, 38 and the support surface. Thereafter, the telescopic cylinders 28, 30 are vented and at the same time the lifting cylinders 52, 54 are synchronously actuated so that the carriages 51, 53 move upwardly. Through this movement the lower run 37, 39 of the support belts 36, 38 at the lower side of the positioning cylinders 28, 30 are drawn out from the stack receiving space with the positioning cylinders 28 and 30 simultaneously becoming shorter. During this procedure the upper run of the support belts rolls off from the lower side of the stack so that the stack slides from the supports 24 and 26 but does not fall.

At approximately the middle of the stroke of the telescopic cylinders 28, 30 the respective holding point of the upper run of the support belts is moved by a predetermined amount relative to the retraction direction of the telescopic cylinders 28, 30. In this way the lowermost products of the stack move towards the rails 14, 16, which in this case serve as abutments, whereby the correct alignment of the stack is ensured.

After the end of the upward movement of the lifting cylinders 52, 54, i.e. the retraction movement of the telescopic cylinders 28, 30, each support belt 36, 38 has been removed from the stack receiving space 22 and the stack lies with the correct alignment on its support. Hereafter, the stack grasper is lifted upwardly while the hold-down devices are moved in the opposite sense downwardly and still press on the top side of the stack. When the hold-down devices 56, 58 have reached their lower end position, they actuate a signal transducer and the vertical position value is read out from the robot control. Immediately thereafter, the stack grasper lifts off fully from the stack and is moved in the direction of the hand-over device so that the cycle can start anew.

If a different format setting is required, the guide rails 14, 16, 18 and 20 are correspondingly adjusted. If, for example, product stacks are conveyed which have a smaller width then the guide rails 14, 16 and 18, 20 are moved towards one another and locked in this position. In order to correspondingly restrict the maximum stroke of the telescopic cylinders 28, 30 with different formats, each carriage 51, 53 can be adjusted by means of a hand lever 64, 66 on an associated guide rod 68, 70 so that the support belt 36, 38 is tensioned.

In accordance with an alternative embodiment, an abutment is provided which restricts the maximum stroke of the lifting cylinders 52, 54 or of the thrust chain. This abutment is advantageously associated with the format adjustment via a cable deflection, whereby the maximum stroke of the support is restricted, depending on the format set, in a manner which is simple design-wise.

What is claimed is:

1. A method of transferring stacks of products having four side edges, the method comprising:

providing a stack grasper apparatus having elongate guide members bounding a stack receiving compartment along four sides thereof, and a stack support on which the stack of products can be supported;

orienting a stack of products in the stack receiving compartment so that the edges of the products extend along the sides of the compartment by positioning the guides at all four sides of the compartment with the bottommost product of the stack in engagement with the stack support extending into the stack receiving compartment;

transferring the product stack received in the stack receiving compartment from one location to another desired transfer location;

positioning the stack support closely adjacent a support surface at the transfer location;

linearly moving the stack support transverse to the elongate guide members and out from the stack receiving compartment to allow the bottommost product to be transferred onto the support surface with the guide members keeping the stack aligned during such transfer so as to avoid having the product stack undergo a free falling action and subjecting the stack to misalignment when the stack support is moved out from the stack receiving compartment for transferring the stack to the support surface;

holding the stack with a holding device against the topmost product in the stack in the stack receiving space;

lifting the stack grasper apparatus away from the support surface after transferring the stack thereto; and displacing the holding device towards the support surface as the stack grasper apparatus is lifted to maintain pressure on the stack with the holding device after transfer of the stack to the support surface and lifting of the stack grasper apparatus away from the support surface.

2. A method of transferring stacks of products, the method comprising:

providing a stack grasper apparatus having elongate guide members bounding a stack receiving space, and a stack support on which the stack of products can be supported;

orienting a stack of products in the stack receiving space with the bottommost product of the stack in engagement with the stack support extending into the stack receiving space;

transferring the product stack received in the stack receiving space from one location to another desired transfer location;

positioning the stack support closely adjacent a support surface at the transfer location;

moving the stack support transverse to the elongate guide members and out from the stack receiving space to allow the bottommost product to be transferred onto the support surface with the guide members keeping the stack aligned during such transfer so as to avoid having the product stack undergo a free falling action and subjecting the stack to misalignment when the stack support is moved out from the stack receiving space for transferring the stack to the support surface;

holding the stack with a holding device against the topmost product in the stack in the stack receiving space;

lifting the stack grasper apparatus away from the support surface after transferring the stack thereto; and displacing the holding device towards the support surface as the stack grasper apparatus is lifted to maintain pressure on the stack with the holding device after transfer of the stack to the support surface and lifting of the stack grasper apparatus away from the support surface;

wherein lifting the stack grasper apparatus causes the holding device to be displaced until the holding device reaches an end point; and activating a signal generator when the holding device reaches the end point to determine the stack height value.

3. Method of palleting stacks of products, the method comprising:

providing a stack grasper apparatus having a stack support on which the stack of products is supported;

positioning the stack support closely adjacent a support surface at a transfer location;

transferring the stack of products to the support surface;

lifting the stack grasper apparatus upwardly and displacing a hold-down device downwardly against the upper side of the stack, so that a pressure is exerted onto the top side of the stack;

wherein lifting the stack grasper apparatus causes the holding device to be displaced until the holding device reaches an end point; and actuating a signal generator when the holding device reaches the end point to determine the stack height value.

4. Method of palleting stacks of products, the method comprising:

providing a stack grasper apparatus having a stack receiving space and stack support on which the stack of products is supported;

positioning the stack support closely adjacent a support surface at a transfer location;

withdrawing the stack support in a substantially horizontal direction out of the stack receiving space to transfer the stack of products to the support surface while simultaneously guiding the stack of products at all sides thereof; and lifting the stack grasper apparatus upwardly, wherein a hold-down device is displaced downwardly against the upper side of the stack, so that a pressure is exerted onto the upper side of the stack;

lifting the stack grasper apparatus causes the hold-down device to be displaced until the hold-down device reaches an end point; and a signal generator is actuated when the hold-down device reaches the end point to determine the stack height value.

* * * * *